US005142650A

United States Patent [19]

Kida et al.

[11] Patent Number: 5,142,650

[45] Date of Patent: Aug. 25, 1992

[54] BOTTOM ELECTRODE FOR A DIRECT CURRENT ARC FURNACE

[75] Inventors: Otojiro Kida, Yokohama; Hiroshi Taketsugu, Takasago, both of Japan

[73] Assignee: Asahi Glass Company Ltd., Tokyo, Japan

[21] Appl. No.: 611,013

[22] Filed: Nov. 9, 1990

[30] Foreign Application Priority Data

| | | | |
|---|---|---|---|
| Nov. 14, 1989 | [JP] | Japan | 1-293996 |
| Feb. 9, 1990 | [JP] | Japan | 2-29941 |
| Jul. 10, 1990 | [JP] | Japan | 2-180601 |

[51] Int. Cl.[5] ..... H05B 7/06

[52] U.S. Cl. ..... 373/88; 373/36; 373/37; 373/38; 373/71; 373/72; 313/331; 219/119; 219/120

[58] Field of Search ..... 373/88, 72, 71, 108, 373/117, 64, 83, 84, 36, 37, 38; 219/119, 120; 313/331, 332, 335; 252/520

[56] References Cited

U.S. PATENT DOCUMENTS

| | | | |
|---|---|---|---|
| 1,091,559 | 3/1914 | Brown | 373/88 |
| 1,912,560 | 6/1933 | Wiles | 373/88 |
| 3,504,219 | 3/1970 | Gejo et al. | 219/145 |
| 3,939,028 | 2/1976 | Schiffarth et al. | 219/145 |
| 4,101,799 | 7/1978 | Wiedijk et al. | 313/331 |
| 4,111,765 | 9/1978 | De Nora et al. | 204/67 |
| 4,720,838 | 1/1988 | Guido | 373/72 |
| 4,730,337 | 3/1988 | Schubert | 373/72 |
| 4,740,990 | 4/1988 | Rader et al. | 373/88 |
| 4,754,464 | 6/1988 | Feuerstake | 373/72 |
| 4,843,614 | 6/1989 | Guido | 373/72 |

FOREIGN PATENT DOCUMENTS

| | | |
|---|---|---|
| 012050 | 6/1980 | European Pat. Off. . |
| 588179 | 9/1982 | European Pat. Off. . |
| 156126 | 10/1985 | European Pat. Off. . |
| 217208 | 4/1987 | European Pat. Off. . |
| 275384 | 7/1988 | European Pat. Off. . |
| 311044 | 4/1989 | European Pat. Off. . |
| 2426738 | 12/1979 | France . |
| 63-103870 | 5/1988 | Japan . |
| 63-134571 | 6/1988 | Japan . |
| 63-134575 | 6/1988 | Japan . |
| 63-37066 | 7/1988 | Japan . |
| 63-37068 | 7/1988 | Japan . |
| 1-213035 | 4/1991 | Japan . |

*Primary Examiner*—Bruce A. Reynolds
*Assistant Examiner*—Tu Hoang
*Attorney, Agent, or Firm*—Oblon, Spivak, McClelland, Maier & Neustadt

[57] ABSTRACT

The service life of a bottom electrode for a direct current arc furnace for producing steel is prolonged by using $ZrB_2$ type sintered bodies for a contacting pins which constitutes a major part of the bottom electrode wherein the $ZrB_2$ type sintered bodies have a corrosion-resistance to molten steel and slag. Further, the number of contacting pins to be used is reduced by forming each of the pins into a form of pillar with a through hole at the axis, or by assembling a plurality of longitudinally divided pin portions to form a contacting pin, whereby the diameter of the contacting pin can be made large. Then the space between contacting pins is made broad, and brick having good corrosion-resistance are filled in the space so that the service life of the bottom electrode is brought closer to that of the refractory lining of the direct current arc furnace.

20 Claims, 9 Drawing Sheets

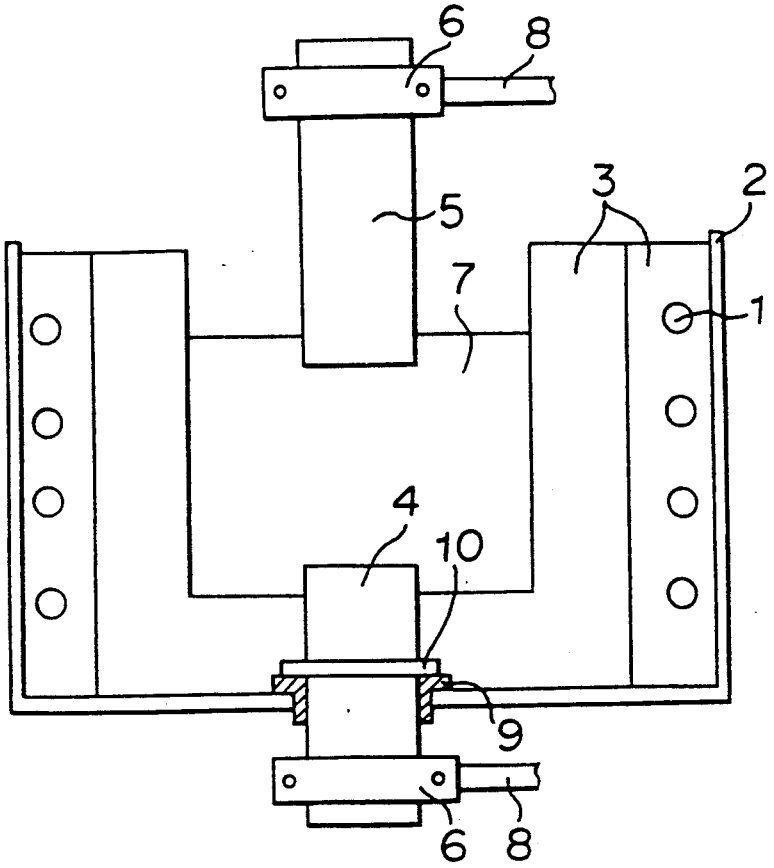
FIGURE 2
FIGURE 3a
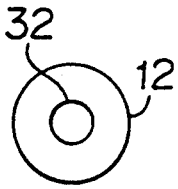
FIGURE 4a
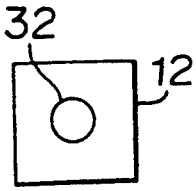
FIGURE 5a
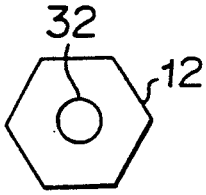
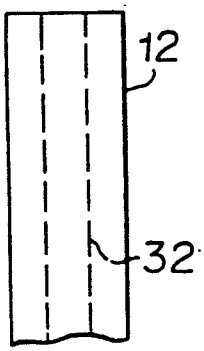
FIGURE 3b
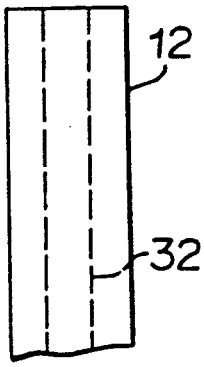
FIGURE 4b
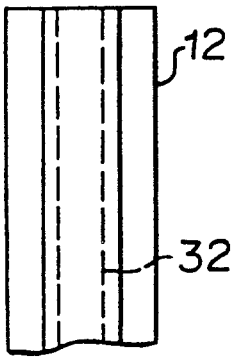
FIGURE 5b FIGURE 8a
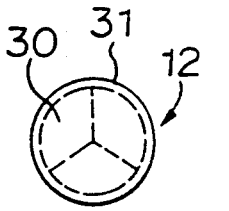
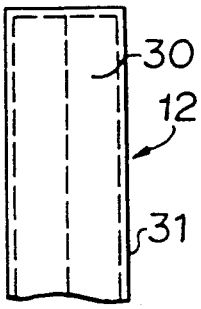
FIGURE 8b
FIGURE 9a
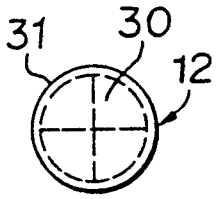
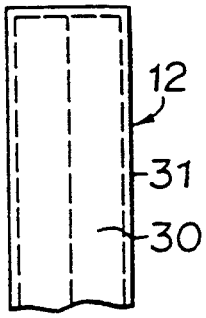
FIGURE 9b
FIGURE 10a
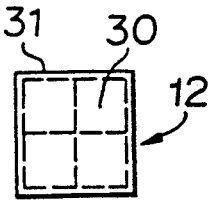
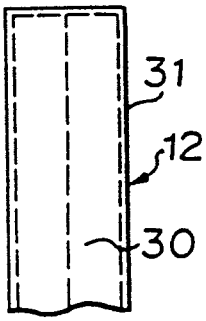
FIGURE 10b
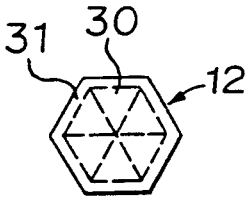
FIGURE 11a
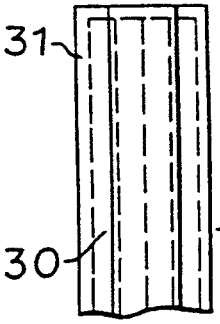
FIGURE 11b FIGURE 12a
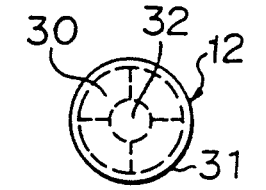
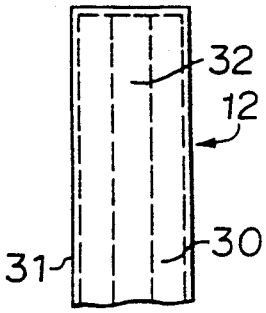
FIGURE 12b
FIGURE 13a
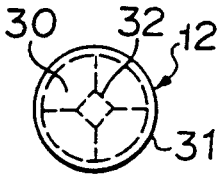
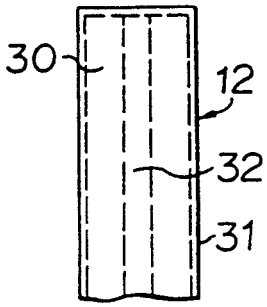
FIGURE 13b
FIGURE 14a
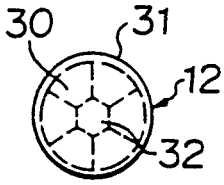
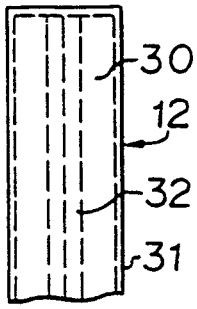
FIGURE 14b
FIGURE 15a
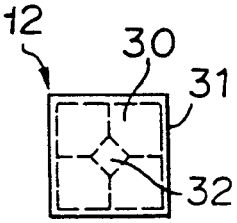
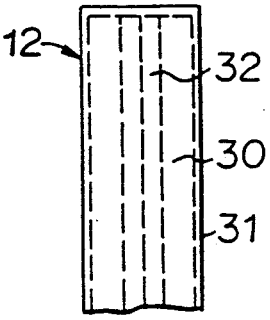
FIGURE 15b
FIGURE 16a
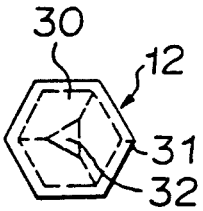
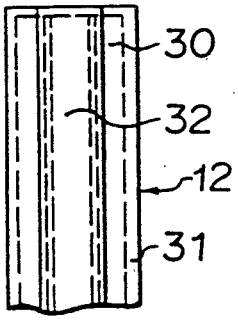
FIGURE 16b

BOTTOM ELECTRODE FOR A DIRECT CURRENT ARC FURNACE

The present invention relates to a bottom electrode for a direct current arc furnace used for producing steel.

A direct current arc furnace used for producing steel is provided with a bottom electrode as an anode at the bottom of the arc furnace and a single graphite electrode as a cathode at the upper part of the arc furnace. In operation, iron scrap and secondary materials are put in the arc furnace, and a direct current arc is generated between the bottom electrode and the upper graphite electrode to thereby convert an electric energy to a thermal energy, and the scrap is molten. Since the direct current arc furnace has the advantages of items from (1) to (4) described below, in comparison with a three-phase (a.c.) arc furnace, the number of the direct current arc furnaces will increase in near future.

(1) Since only a single cathode electrode is used, the surface area of the graphite cathode electrode to be consumed is small. Further, the load to the end of the cathode electrode is small because of the cathode characteristics, consumption of the graphite cathode electrode is small, and the consumption rate (per unit ton of steel production) of the graphite cathode electrode can be reduced to about 50%.

(2) Noises of the direct current arc furnace during melting operation is small as 90 db or lower in comparison with the noise level of 110 db in a conventional a.c. arc furnace having the same capacity.

(3) Since the direct current arc furnace has a single cathode electrode, and the arc is discharged downwardly in the substantially vertical direction, a relatively uniform temperature distribution is obtainable, whereby a hot spot which accelerates the consumption of furnace lining around the cathode electrode is not produced.

(4) There is no induction loss which is inavoidable in the a.c. arc furnace and energy can be utilized efficiently. Accordingly, the time for melting and smelting is shortened and the consumption rate of power can be reduced.

In a direct current arc furnace, generally, the anode (bottom electrode) in contact with molten metal and furnace lining around the cathode electrode are consumed with the elapse of operating time. These consumptions are caused mainly by corrosion by the molten metal. In particular, the consumption is remarkable in metallic contacting pins which are used as a bottom electrode. Usually, when the length of the contacting pins reaches the limit of use, replacement of the bottom electrode is required.

A conventional bottom electrode for a direct current arc furnace comprises relatively thin contacting pins (for instance, about 40 mm in diameter), which extends in the vertical direction, and are made of an electric conductive metal such as low carbon steel (mild steel). In order to protect a plurality of contacting pins, a magnesia type stamp material (a kind of monolithic refractory) is filled in an iron casing so as to surround the contacting pins.

In the conventional bottom electrode, however, when an amount of molten steel is poured out and the remaining molten steel in the furnace becomes small, the slag floating on the surface of the molten steel comes into contact with the magnesia type stamp material, and reacts to produce compounds having a low melting point, so that consumption of the stamp material is remarkable. Namely, the consumption rate of the magnesia type stamp material is fast as 0.5 mm–1.0 mm per hour. In particular, the central portion of the bottom electrodes is consumed faster than the circumferential portion. Accordingly, it is necessary to replace the electrodes at intervals of about 700 heat (each heat corresponds to about 1 hour operation time), i.e. at every month or so. In other words, the service life of the bottom electrode determines the time interval of repairing the direct current arc furnace; thus, the repairing has to be frequently conducted.

Further, there is a problem in the replacement of the bottom electrode as follows.

In a case of replacing a bottom electrode, operators have to wait until the temperature in the furnace decreases to a level which enables them to work therein. Then, the operators enter in the furnace t replace the consumed bottom electrode by a new bottom electrode which includes laying operation of monolithic refractory under a fairly high temperature condition. The replacing operations require about 8 hours in addition to a time for cooling the furnace, whereby productivity of the furnace is reduced. Further, the thermal stress caused during the cooling of the furnace accelerates the consumption of the furnace lining around the portion to be repaired, and the consumption rate of the furnace lining further increases.

The service life of the furnace lining except for the bottom electrode is normally about 1 year. Therefore, it is expected that the service life of the bottom electrode is prolonged to a period of the service life of the furnace lining.

It is an object of the present invention to provide a bottom electrode for a direct current arc furnace having a small consuming speed and a long service life.

In accordance with the present invention, there is provided a bottom electrode for a direct current arc furnace comprising a plurality of contacting pins elongated in the vertical direction, each having an exposed upper portion which is brought into contact with a batch to be molten to heat the batch through the discharge of an electric arc, a refractory filled to surround the lower portion of the contacting pins extending from the exposed upper portion, a connecting member to be connected to a power source, which is provided at the lower ends of the contacting pins, and a cooling means to cool the connecting member, and the contacting pins formed of a zirconium boride type sintered body.

In a preferred embodiment of the bottom electrode for a direct current arc furnace of the present invention, the zirconium boride type sintered body contains from 15 wt % to 50 wt % of grog having a grain size larger than 28 meshes (sieve openings 0.589 mm).

In another preferred embodiment of the bottom electrode for a direct current arc furnace of the present invention, the zirconium boride type sintered body further includes from 3 wt % to 40 wt % of carbon.

In another preferred embodiment of the bottom electrode for a direct current arc furnace of the present invention, each of the contacting pins has a pillar-shaped body having a through hole formed at the axis, and a refractory is filled in the through hole.

In another preferred embodiment of the bottom electrode for a direct current arc furnace of the present invention, the refractory filled in the through hole is zirconium boride type monolithic refractory.

In another preferred embodiment of the bottom electrode for a direct current arc furnace of the present invention, each of the contacting pins is an assembled body of a plurality of longitudinally divided pin portions.

In another preferred embodiment of the bottom electrode for a direct current arc furnace of the present invention, the number of the longitudinally divided pin portions is from 3 to 7.

In another preferred embodiment of the bottom electrode for a direct current arc furnace of the present invention, the assembled body of the longitudinally divided pin portions is bound with a metallic band or sleeve so as to surround the circumferential area of the assembled body.

In another preferred embodiment of the bottom electrode for a direct current arc furnace of the present invention, metallic plates are interposed between matching surfaces of the longitudinally divided pin portions.

In another preferred embodiment of the bottom electrode for a direct current arc furnace of the present invention, the edges formed in the longitudinally divided pin portions are chamfered or rounded.

In another preferred embodiment of the bottom electrode for a direct current arc furnace of the present invention, a metallic cap is put on each of the contacting pins so as to cover at least its upper portion.

In another preferred embodiment of the bottom electrode for a direct current arc furnace of the present invention, at least the upper portion of the refractory filled to surround the lower portion of the contacting pins extending from the exposed upper portion is a zirconium boride type monolithic refractory.

In another preferred embodiment of the bottom electrode for a direct current arc furnace of the present invention, at least the upper portion of the refractory filled to surround the lower portion of the contacting pins extending from the exposed upper portion are bricks.

In another preferred embodiment of the bottom electrode for a direct current arc furnace of the present invention, the bricks are magnesia graphite type bricks or zirconium boride type bricks.

In another preferred embodiment of the bottom electrode for a direct current arc furnace of the present invention, lower portions of the contacting pins are held by a connecting means comprising a metallic member having a larger thermal expansion coefficient and a metallic member having a smaller thermal expansion coefficient so as to eliminate looseness due to temperature rise, and are electrically connected to the power source.

In drawings:

FIG. 2 is a longitudinal cross-sectional view of a testing electric furnace used for tests of electrodes;

Figure 6:
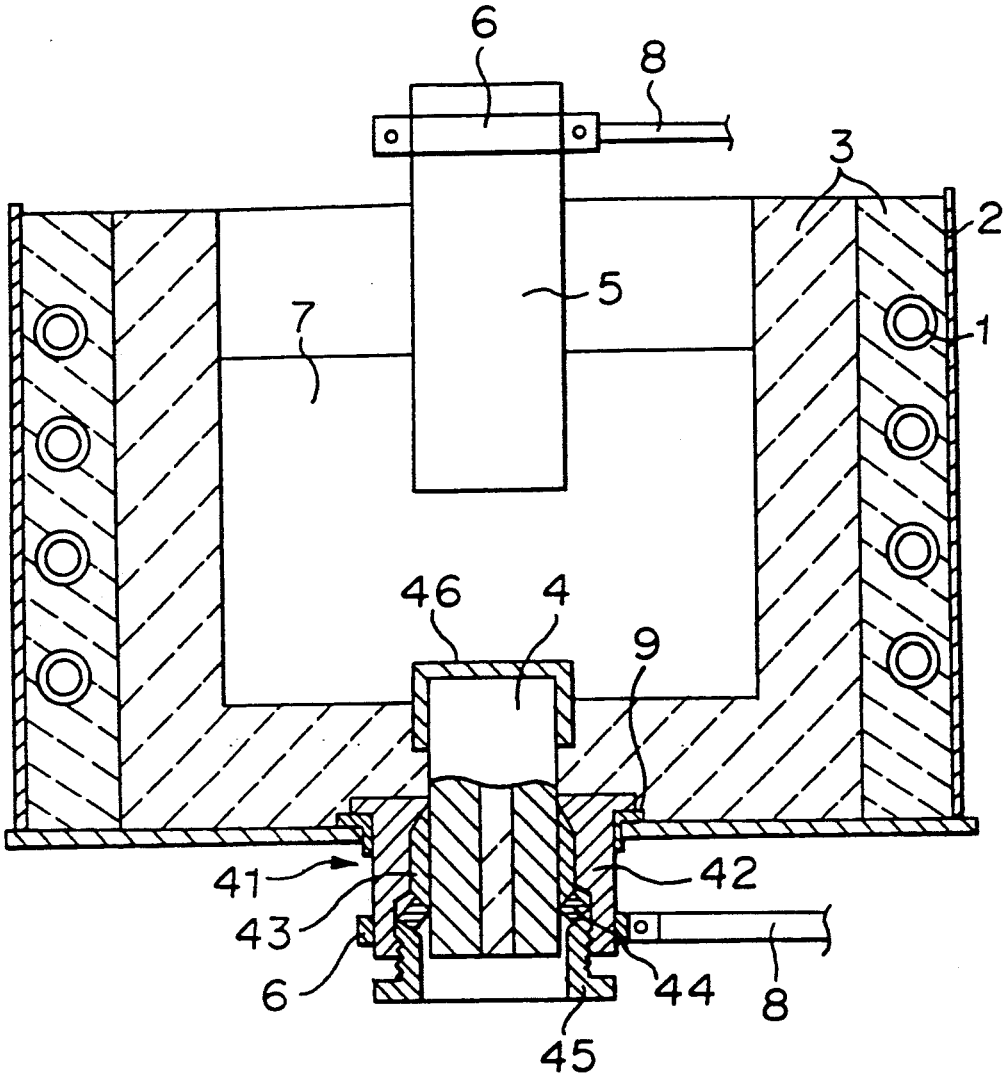
Figure 7:
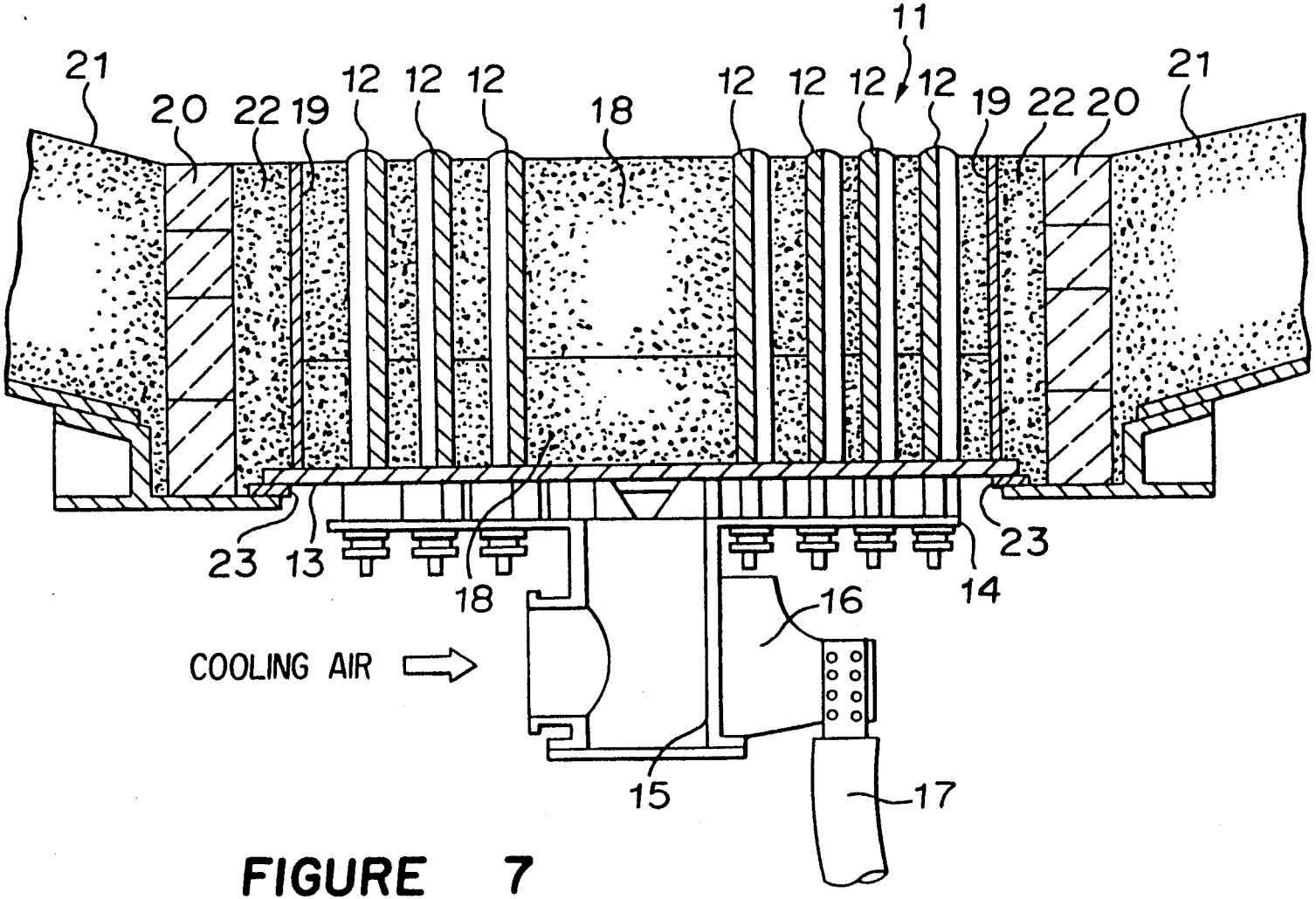
Figure 23:
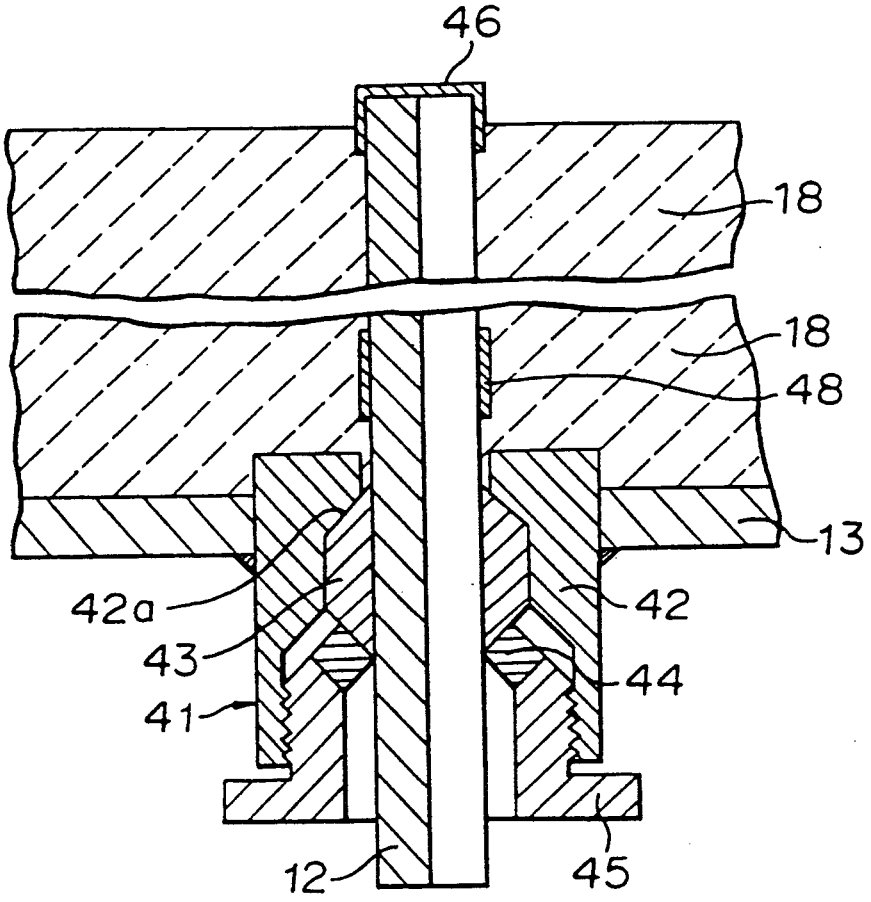
Figure 24:
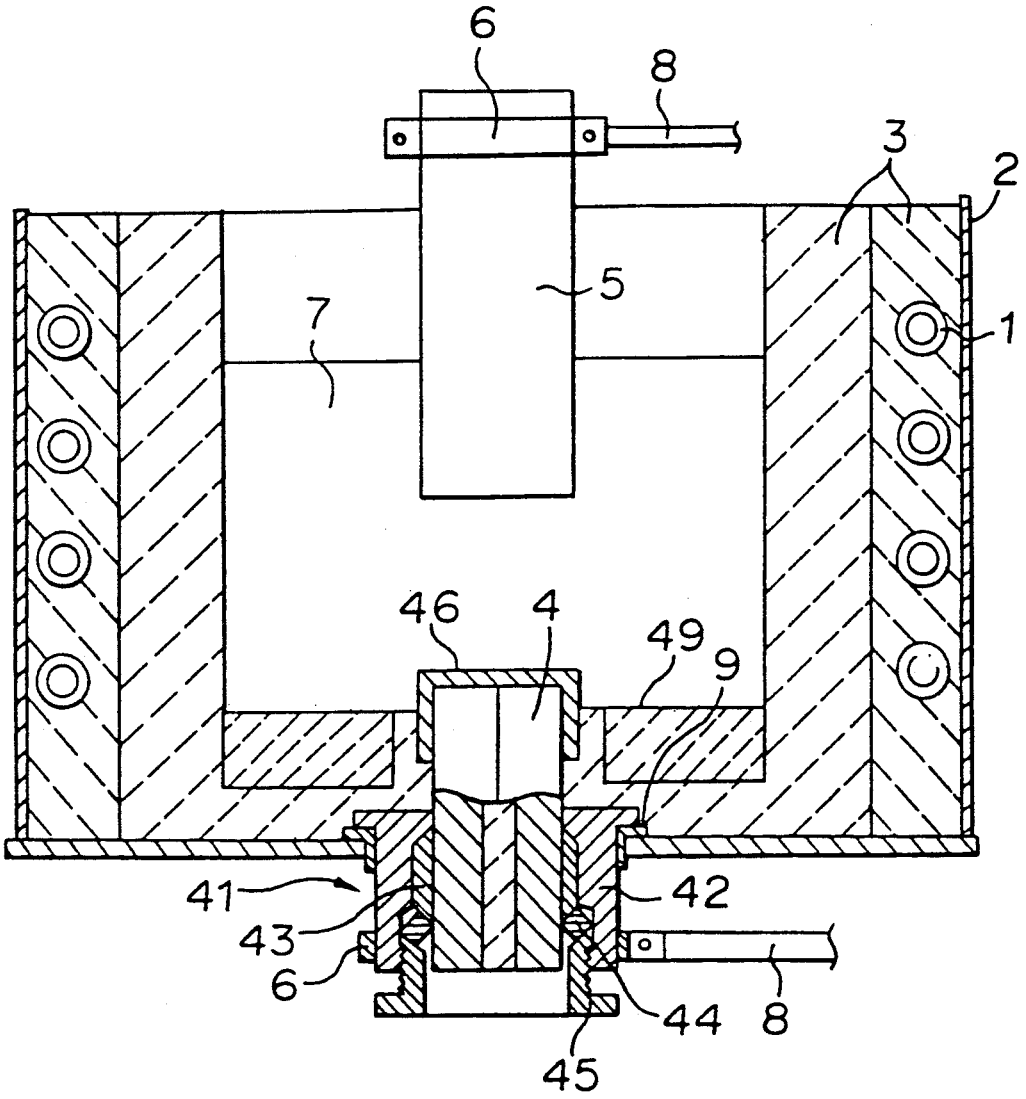

FIGS. 3*a* and 3*b*, FIGS. 4*a* and 4*b* and FIGS. 5*a* and 5*b* are respectively plan views and front views partly omitted of preferred embodiments of contacting pins used for the bottom electrode for a direct current arc furnace of the present invention;

FIG. 6 is a longitudinal cross-sectional view of another testing electric furnace used for tests of electrodes;

FIG. 7 is a longitudinal cross-sectional view partly omitted of a preferred embodiment of the bottom electrode for a direct current arc furnace according to the present invention;

FIGS. 8*a* and 8*b*, FIGS. 9*a* and 9*b*, FIGS. 10*a* and 10*b*, FIGS. 11*a* and 11*b*, FIGS. 12*a* and 12*b*, FIGS. 13*a* and 13*b*, FIGS. 14*a* and 14*b*, FIGS. 15*a* and 15*b* and FIGS. 16*a* and 16*b* are respectively plan views and front views partly omitted of other preferred embodiments of contacting pins used for the bottom electrode of the present invention;

FIGS. 17, 18, 19, 20, 21 and 22 are respectively transverse cross-sectional views of other preferred embodiments of contacting pins used for the bottom electrode for a direct current arc furnace of the present invention;

FIG. 23 is a longitudinal cross-sectional view partly omitted of a preferred embodiment of a connecting structure to connect a contacting pin to a power source in the bottom electrode for a direct current arc furnace of the present invention; and FIG. 24 is a longitudinal cross-sectional view schematically showing a testing model furnace with which a bottom electrode for a direct current arc furnace was tested.

Detailed description will be made as to the bottom electrode for a direct current arc furnace of the present invention.

In the present invention, zirconium boride type sintered bodies are used for contacting pins. The zirconium boride type sintered body has a melting point of 3000° C. or higher; shows excellent corrosion resistance to slag and molten metal, especially molten steel, and has the same level of electric conductivity as currently used mild steel. Namely, the zirconium boride type sintered body is suitable for the electrode material. Accordingly, by forming contacting pins by use of zirconium boride type sintered bodies, there is obtainable a bottom electrode for a direct current arc furnace, which has a small consuming rate and a long service life, in particular, for producing steel.

The contacting pin of a zirconium boride type sintered body is formed to have a thin shape, whereby a dense sintered body is obtainable, and a thermal stress produced inside the sintered body when the contacting pin is heated during use is small. A large current load can be supplied to a large sized direct current arc furnace by providing a plurality of the contacting pins. Since the zirconium boride type sintered body is expensive, it is unnecessary to use the contacting pins in a number more than required. A refractory is filled around the contacting pins. The connecting means to connect the contact pins to a power source is provided at a lower portion, which is kept at a lower temperature, of the bottom electrode for a direct current arc furnace constructed in accordance with the present invention.

Since currently used contacting pins made of mild steel are poor in corrosion resistance to molten steel, it was impossible to use the contacting pin having a large diameter. Although a contacting pin of a zirconium boride type sintered body can eliminate such a limitation, but it requires some contrivance because ceramics is fragile. Although it is desirable to form the contacting pins used for the bottom electrode for a direct current arc furnace of the present invention with a dense zirconium boride type sintered bodies because they have excellent electric conductivity, the dense sintered bodies can not be used without special attention to heating and cooling because they have small thermal spolling resistance. Accordingly, it is preferable to improve the thermal spolling resistance of the sintered bodies by incorporating coarse particles, and preferably by further incorporating carbon. The incorporation of the carbon improves the thermal spolling resistance of the sintered bodies without killing the advantage of electric conductivity. When the content of these incorporated materials is too small, an improvement on the thermal spolling resistance can not be obtained. On the other hand, it is too much, the electric conductivity and the strength of the sintered body are disadvantageously small. As the cross-sectional area of a contacting pin is made large, i.e. the diameter is made large, the power capacity through a contacting pin becomes large. However, when the contacting pin is formed of a zirconium boride type sintered body and if the diameter is made large, a sintered body having homogenized and dense microstructure can not be obtained because there produces a difference in the degree of sintering between a portion near the surface and the inside of the sintered body. Thereby, the sintered body is poor in electric conductivity and mechanical strength as a whole, and when a contacting pin is formed of the sintered body, satisfactory performance can not be obtained. Further, even when a large, dense contacting pin can be produced by a method such as a hot isostatic pressing, the contacting pin is weak to the thermal stress induced by a temperature distribution at the time of heating or cooling.

In a preferred embodiment of the bottom electrode for a direct current arc furnace of the present invention, the contacting pin is a pillar-shaped body having a through hole formed at the axis. Thereby, even when a contacting pin having a large diameter is formed, the bulk thickness is small, and a uniform dense sintered body can be obtained. As a result, even when a large-sized contacting pin having a large diameter is formed, it is possible to obtain a contacting pin having excellent electric conductivity and mechanical strength. And, by making the diameter of the contacting pin large, the current load of a contacting pin can be made large whereby a large output can be obtained with a bottom electrode comprising a small number of contacting pins.

A bottom electrode with a small number of contacting pins shortens the time for its construction.

It is preferable to fill zirconium boride type monolithic refractory or a similar material in the through hole formed in the contacting pin because the thermal expansion difference between the contacting pin and the zirconium boride type monolithic refractory is small and the refractory has excellent corrosion resistance.

For the refractory filled to surround the lower portion of contacting pins extend from the exposed upper portion, the zirconium boride type monolithic refractory having durability is preferably used, whereby the service life of the bottom electrode can be prolonged in comparison with the case that a magnesia type stamp material is used.

In a preferred embodiment of the bottom electrode of the present invention, each of the contacting pin is assembled with a plurality of longitudinally divided pin portions each being formed of a zirconium boride type sintered body. Accordingly, even though the assembled contacting pin has a large diameter as a whole, the wall thickness of each of the longitudinally divided pin portions can be thin. Therefore, when a contacting pin of a zirconium boride type sintered body is formed by sintering the longitudinally divided pin portion, a uniform, dense microstructure is obtainable. Thus, a single, large contacting pin is formed by assembling a plurality of the longitudinally divided pin portions of a zirconium boride type sintered body having uniform, dense microstructure. By dividing a contacting pin into thin pin portions, the thermal stress during use can be reduced remarkably. Accordingly, the contacting pin having excellent electric conductivity and excellent thermal spolling resistance can be obtained even though it has a large diameter. Thus, by making the diameter of the contacting pin large, it is possible to increase the current load of a single contacting pin and to obtain a large output.

In a preferred embodiment of the bottom electrode of the present invention, the number of longitudinally divided pin portions of a contacting pin is from 3 to 7, whereby a sufficiently large contacting pin can be easily formed.

Further, the contacting pin as an assembled body of the longitudinally divided pin portions may be bound with a metallic band or sleeve so as to surround a circumferential portion of the assembled body, whereby the divided pin portions are unified into a piece; handling at the time of fitting the electrode to a furnace can be easy, good electric contact between divided pin portions is obtainable so that an admissible current capacity of the contacting pin can be increased as a whole.

Further, metallic plates are inserted between matching surfaces of the longitudinally divided pin portions when they are assembled into a contacting pin. Accordingly, electric contact between the longitudinally divided pin portions is further improved, and a current load of each of the pin portions can be equalized, whereby a large current can be fed through an assembled contacting pin.

Further, since edges of the longitudinally divided pin portions are chamfered or rounded, undesired breaking of the edge in handling can be avoided. Further, a damage in the contacting pin such as breaking of the edge because of a thermal stress resulting from a temperature difference caused when the edge is rapidly heated to an elevated temperature, is prevented.

Further, a metallic cap is put on the top of the contacting pin so as to cover at least an upper portion of the contacting pin, whereby formation of a zirconium oxide layer at the surface of the contacting pin during the heating of the furnace is prevented (the zirconium oxide surface layer generates by oxidation of the zirconium boride type contacting pin by heating it in air), and reduction in electric conductivity of the surface of the contacting pin in contact with molten steel is prevented. Further, the metallic cap functions as a shock absorbing material, and it improves strength to a mechanical impact when scrap is put in the furnace.

As the refractory to be filled to surround a lower portion of the contacting pin, a magnesia type stamp material is usually used. However, the durability of a bottom electrode can be further improved by using zirconium boride type monolithic refractory having excellent corrosion resistance. As the zirconium boride type monolithic refractory, a stamp material is preferably used rather than a castable material because the stamp material includes less water content and shortens the drying time after laying operation.

Usually, a bottom electrode is not used until corrosion reaches near to the bottom portion of the furnace lining. Accordingly, it is desirable that the refractory has a two layered structure wherein the magnesia type stamp material constitutes a lower layer because the manufacturing cost of the furnace can be reduced, and the magnesia type stamp material has a small thermal conductivity and reduces the temperature of the connecting means to that of a power source. In order to reduce the temperature of the connecting means to a power source, the thickness of a bottom electrode may be increased. In this case, however, long contacting pins are needed. In order to avoid to use long contacting pins, the bottom portion of the bottom electrode is forcibly cooled so that it is unnecessary to increase the thickness of the bottom electrode.

In a preferred embodiment of the bottom electrode for a direct current arc furnace of the present invention, each of the contact pins is made large. Accordingly, spaces between the adjacent contact pins can be broaden, whereby it is possible to lay bricks. Since the bricks have a high density in comparison with monolithic refractory, the service life of a bottom electrode can be further prolonged by lining the spaces between the contacting pins, in particular, upper portions of the spaces, by using bricks having good durability.

Further, at least the upper portion of the refractory surrounding a lower portion of the contacting pin is preferably constituted by a zirconium boride type refractory or magnesia graphite type bricks, whereby a bottom electrode for a direct current arc furnace having a prolonged service life and a reliability can be obtained.

Lower end of the contacting pins are held by a connecting means comprising a metallic member having a large thermal expansion coefficient and a metallic member having a small thermal expansion coefficient and the connecting means is connected to a power source, whereby it is possible to eliminate looseness at a fastening portion caused by the difference of thermal expansion between zirconium boride type ceramics having a thermal expansion coefficient of about ½ as that of ordinary metal and the metallic member, and electric current interruption between the contacting pins and the power source can be prevented even when the connecting means is heated.

Several embodiments of the bottom electrode for a direct current arc furnace of the present invention will be described in detail. However, the present invention is not limited by these embodiments.

Figure 1:
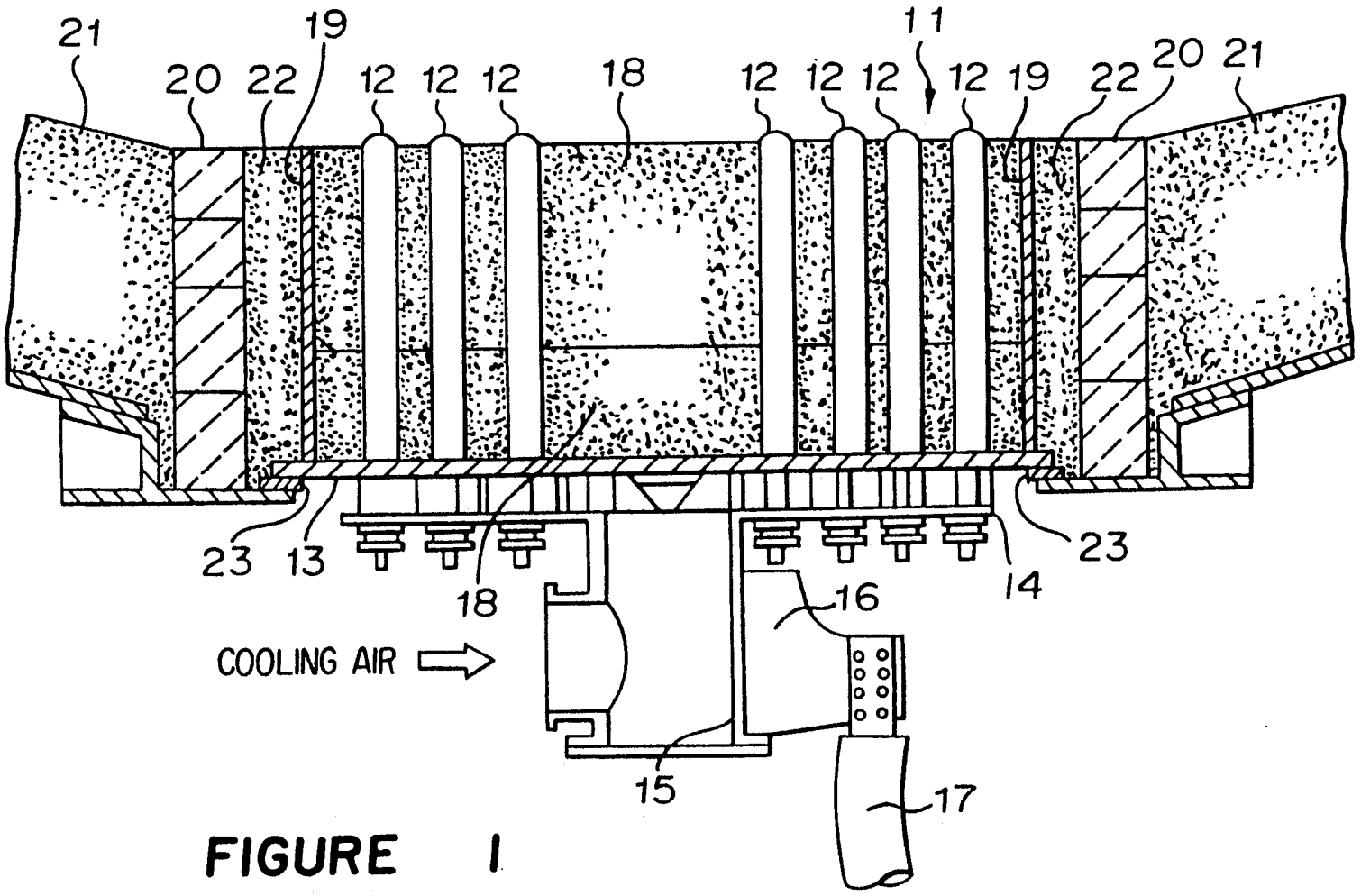
FIG. 1 is a longitudinal cross-sectional view partly omitted of an embodiment of the bottom electrode for a direct current arc furnace according to the present invention.

FIG. 1 is a longitudinal cross-sectional view partly omitted of an embodiment of the bottom electrode for a direct current arc furnace of the present invention. A bottom electrode 11 is embedded in the central portion of the bottom of a direct current arc furnace. The bottom electrode 11 is formed in a form of unit and is surrounded by block bricks 20 provided at suitable places in refractory 21 for lining the furnace. Magnesia type monolithic refractory 22 is filled in spaces between a casing 19 for the bottom electrode 11 and the block bricks 20. Magnesia graphite type bricks are used as the block bricks 20. A water-cooled cable 17 connected to the bottom electrode 11 is connected to the anode terminal of a direct current power source (not shown). On the other hand, the cathode terminal of the power source is connected to a graphite electrode (not shown). The graphite electrode penetrates the roof of the direct current arc furnace, and has its end facing a batch to be molten in the furnace. The power source usually used has a capacity of 120,000 Ampere or higher.

The water-cooled cable 17 connected to the bottom electrode 11 is connected to an electrode terminal 16 which is, in turn, connected to a current collecting plate 14 through a cool air feeding pipe 15. A base plate 13 is provided just above the current collecting plate 14. The base plate 13 and the current collecting plate 14 are provided in the substantially horizontal direction and in parallel to each other. The base plate 13 is supported by the iron shell of the furnace main body through a bracket 23. The base plate 13 is electrically isolated from the furnace shell by means of the bracket 23 which is made of an electric insulating material.

A plurality of (e.g. 40) contacting pins 12 formed of zirconium boride type sintered bodies are set up in parallel to each other and penetrates the base plate 13 wherein the lower end portion of each of the contacting pins 12 is connected to and held by the current collecting plate 14. The casing 19 made of steel is provided on the upper surface of the base plate 13 so as to surround a group of the contacting pins 12 embedded in refractory 18.

The refractory 18 is laid in the casing 19, and the major portion of the lower portion excluding its upper portion of each of the contacting pins 12 is embedded in the refractory 18. In this embodiment, the refractory 18 has a two-layered structure which comprises a lower layer of a magnesia type stamp material and an upper layer of zirconium boride type monolithic refractory. The thickness of the refractory 18 including the upper and lower layers is, for instance, in a range from 70 cm to 100 cm, and the upper end portion of each of the contacting pins 12 slightly projects from the upper surface of the refractory 18.

When a bottom electrode 11 is to be attached to the bottom of the direct current arc furnace, a bottom electrode 11 which has been used and consumed is raised and removed, and used block bricks 20 are replaced by new ones. While, new contacting pins 12 are arranged inside the other set of the steel casing 19 and the base plate 13, and monolithic refractory 18 is laid. Thus a bottom electrode 11 which has been separately prepared is hanged down from the upper side of the furnace so that the bottom electrode 11 is fitted to the opening of the bottom of the furnace which is surrounded by the block bricks 20. In this case, the bracket 13 of an electric insulating material is previously provided at a predetermined position so that the bottom electrode 11 is isolated from the furnace shell. Then, a magnesia type castable joint material 22 is applied to the gap between the steel casing 19 of the bottom electrode 11 and the block bricks 20 and the cable 17 is connected to the electrode terminal 16, and thereafter, an air supplying pipe (not shown) is connected to a cool air intake port of the feeding pipe 15.

When a batch of steel is smelted by using the above-mentioned direct current arc furnace, predetermined amounts of scrap and secondary materials are put in the furnace and a direct electric current is supplied between the bottom electrode 11 and the graphite electrode. Then, arc discharges are resulted between the graphite electrode and the scrap to be molten. The direct electric current flows into the scrap in the furnace through the cable 17, the current collecting plate 16, the cool air feeding pipe 15 and a plurality of the contacting pins 12. The electric current further flows to the graphite electrode through arc discharges. Cooling air to cool the bottom of the bottom electrode 11 is supplied from the feeding pipe 15 in the upward direction and it flows radially in a space between the base plate 13 and the current collecting plate 14.

As the material of the contacting pins 12, the zirconium boride type sintered body as shown in Table 1 can be used, for instance.

TABLE 1

| | a. Carbon-containing coarse particle type | b. Coarse particle blend type |
|---|---|---|
| Composition | Carbon 3–40 wt %<br>$ZrB_2$ 97–60 wt % | $ZrB_2$ 90 wt % or higher |
| $ZrB_2$ coarse particle content | 4–28 mesh 15–50 wt % | 4–28 mesh 15–50 wt % |

The zirconium boride type sintered body has the physical properties as shown in Table 2.

TABLE 2

| | a. Carbon-containing coarse particle type | b. Coarse particle blend type |
|---|---|---|
| Bulk density | 4.0–4.5 g/cm$^3$ | 4.8–5.5 g/cm$^3$ |
| Bending strength | 250–500 kg/cm$^2$ | 350–600 kg/cm$^2$ |
| Electric resistivity | $10^{-4}$ Ωcm or lower | $10^{-4}$ Ωcm or lower |
| Thermal expansion coefficient | 5–5.5 × $10^{-7}$/°C. | 5.4–5.7 × $10^{-7}$/°C. |
| Thermal shock resistance | ΔT; 1100° C. or higher | ΔT; 900° C. or higher |

As zirconium boride type monolithic refractory, one as shown in Table 3 is preferably used, for instance.

TABLE 3

| | | |
|---|---|---|
| Composition | $ZrB_2$<br>Alumina cement and others | 90 wt % or higher<br>10 wt % or lower |
| $ZrB_2$ coarse particle content | 4–28 mesh | 15–50 wt % |
| Bulk density | 4.4–4.8 g/cm$^3$ | |
| Bending strength | 100–170 kg/cm$^2$ | |
| Thermal expansion coefficient | 5.5–5.7 × $10^{-7}$/°C. | |
| Thermal shock resistance | ΔT; 900° C. | |

$ZrB_2$ content in the zirconium boride type monolithic refractory used is preferably 90 wt % or higher in order to assure corrosion resistance. Since the zirconium boride type monolithic refractory is sintered at a temperature of about 1500° C. or higher, and by heating to such a temperature, thereby obtains electric conductivity, and the refractory functions as a part of the bottom electrode.

Preferred embodiments of the contacting pin 12 of the bottom electrode 11 will be described.

FIGS. 3 through 5 show respectively the shapes of the contacting pin 12 used for the present invention.

The contacting pin 12 shown in FIG. 3 is in a generally cylindrical shape in which a through hole 32 at the axis of the pin 12 is formed.

The contacting pin 12 shown in FIG. 4 is in a generally square pillar shape in which a through hole 32 extending at the axis of the pin is formed.

The contacting pin 12 as shown in FIG. 5 is a generally hexagonal pillar shape in which a through hole 32 extending at the axis of the pin is formed. Thus, each of the contacting pins of preferred embodiments which are used for the bottom electrode for a direct current arc furnace of the present invention has a pillar shape having a through hole 32 which extends at the axis of the contacting pin. The shape of the contacting pin 12 may have various shapes such as a cylindrical shape, a many sided pillar shape and so on. Further, the through hole 32 may have an angular hole other than a cylindrical shape.

In a preferred embodiment of the bottom electrode for a direct current arc furnace of the present invention, because a pillar-shaped body having a through hole 32 at the axis is used as the above-mentioned contacting pin 12, it is possible to obtain a contacting pin formed of zirconium boride type sintered body having uniform, dense microstructure even though the diameter of the contacting pin 12 is made large. Accordingly, a contacting pin 12 having excellent performance such as electric conductive property can be obtained. Further, the contacting pin having a through hole 32 extending in the vertical direction at the axis is effective to reduce a thermal stress resulting from a temperature difference which is produced inside the contacting pin, and is effective to avoid thermal spolling.

Further, zirconium boride type monolithic refractory is filled in the through hole 32 of the contacting pin 12, whereby invasion of molten steel is prevented and the durability of the contacting pin can be improved.

FIG. 7 shows another preferred embodiment of the bottom electrode for a direct current arc furnace of the present invention wherein contacting pins of a cylindrical shape each comprising a plurality of divided pin portions are used instead of the contacting pins of a cylindrical shape as shown in FIG. 1.

FIGS. 8 through 22 respectively show other preferred embodiments of a contacting pins used for the bottom electrode for a direct current arc furnace of the present invention, the contacting pin being formed by assembling a plurality of longitudinally divided pin portions.

The contacting pin 12 as shown in FIG. 8 is formed by assembling three divided pin portions 30 each having a sector shape in cross section so that the assembled body has a cylindrical shape as a whole. The assembled body is bound by a metallic sleeve 31 to cover an outer circumferential portion. In this case, the sleeve 31 is adapted to cover not only the outer circumference but also the top surface of the contacting pin 12, whereby the divided pin portions 30 are bound, and the contacting pin 12 is prevented from damaging by a shock at the time of putting scrap in the furnace.

The contacting pin 12 as shown in FIG. 9 is formed by assembling four longitudinally divided pin portions 30 each having a sector shape in cross section so that the assembled body has a cylindrical shape as a whole. The assembled body is bound by a metallic sleeve 31 to cover an outer circumferential portion.

The contacting pin 12 as shown in FIG. 10 is formed by assembling four divided pin portions 30 each having a square shape in cross section so that the assembled body has a square pillar shape as a whole. The assembled body is bound by a metallic sleeve 31 to cover an outer circumferential portion.

The contacting pin 12 as shown in FIG. 11 is formed by assembling six divided pin portions 30 each having a regular triangular shape in cross section so that the assembled body has a regular hexagonal pillar shape as a whole. The assembled body is bound by a metallic sleeve 31 to cover an outer circumferential portion.

Thus, various shapes of the contacting pin 12 can be formed by assembling a desired number of longitudinally divided pin portions 30 having a desired shape.

The contacting pin 12 as shown in FIG. 12 is an assembled body formed by assembling four longitudinally divided pin portions 30 having a sector shape in cross section so that the assembled body has a generally cylindrical body wherein a through hole 32 having a circular shape in cross section extends longitudinally at the axis of the assembled body. Further, the assembled body is bound by a metallic sleeve 31 of mild iron to cover an outer circumferential portion. The assembled body is used in a state that monolithic refractory is filled in the circular through hole, whereby leakage of molten steel from the through hole is prevented.

The contacting pin 12 as shown in FIG. 13 has the substantially same shape as that in FIG. 12 except that a through hole 32 having a square shape in cross section is formed at the axis of the assembled body.

The contacting pin 12 as shown in FIG. 14 is an assembled body formed by assembling six longitudinally divided pin portions 30 each having a sector shape in cross section so that the assembled body is in a cylindrical pillar shape as a whole wherein a through hole 32 having a regular hexagonal shape in cross section extends in the longitudinal direction at the axis of the assembled body. Further, the assembled body is bound by a metallic sleeve 31 to cover an outer circumferential portion.

The contacting pin 12 as shown in FIG. 15 is an assembled body formed by assembling four longitudinally divided pin portions 30 each having a square shape in cross section wherein a corner edge of the square shape is chamfered. The assembled body has a regular rectangular pillar shape as a whole and a through hole 32 having a square shape in cross section is formed so as to penetrate longitudinally the axis of the assembled body. Further, the assembled body is bound by a metallic sleeve 31 to cover an outer circumferential portion.

The contacting pin 12 as shown in FIG. 16 is an assembled body formed by assembling three longitudinally divided pin portions 30 each having a diamond shape in cross section wherein a corner edge is chamfered. The assembled body is in a regular hexagonal pillar shape as a whole and a through hole 32 having a triangular shape in cross section penetrates longitudinally the axis of the assembled body. Further, the assembled body is bound by a metallic sleeve 31 to cover an outer circumferential portion.

Figure 17:
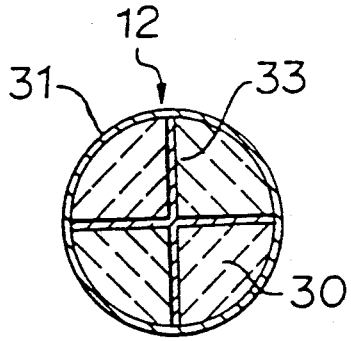

The contacting pin 12 as shown in FIG. 17 is substantially the same as that shown in FIG. 9 except that metallic plates 33 of mild iron are inserted between matching surfaces of adjacent pin portions 30.

Figure 18:
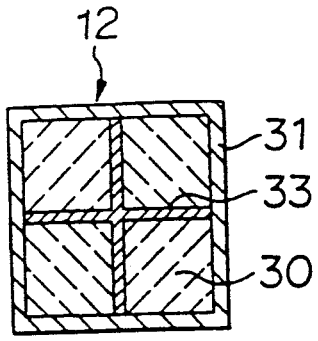

The contacting pin 12 as shown in FIG. 18 is the substantially same as that of the contacting pin 12 shown in FIG. 10 except that metallic plates 33 are inserted between matching surfaces of adjacent pin portions 30.

Figure 19:
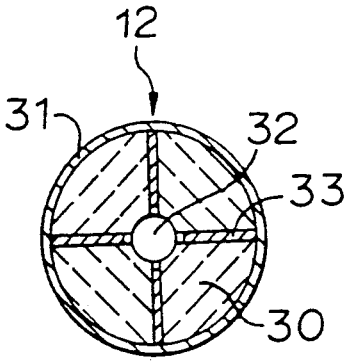

The contacting pin 12 as shown in FIG. 19 is the substantially same as that of the contacting pin 12 shown in FIG. 12 except that metallic plates 33 are inserted between matching surfaces of adjacent pin portions 30.

Figure 20:
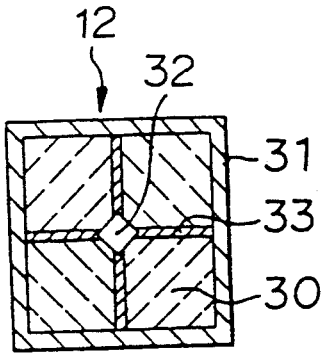

The contacting pin 12 as shown in FIG. 20 is the substantially same as that of the contacting pin 12 shown in FIG. 15 except that metallic plates 33 are inserted between matching surfaces of adjacent pin portions 30.

In the above-mentioned embodiments of the contacting pin 12, since the metallic plates 33 of mild steel is softer than the longitudinally divided pin portions of zirconium boride type sintered body, they can closely contact with the adjacent pin portions 30 to thereby increase electric contacting conductivity. Further, they contribute to provide equalized current density among the pin portions 30 to thereby increase current capacity of a contacting pin.

Figure 21:
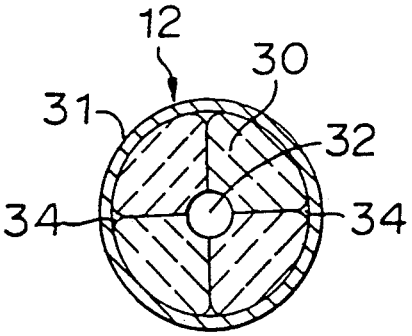

The contacting pin 12 as shown in FIG. 21 is the substantially same as that shown in FIG. 12 except that edges 34 of each of the longitudinally divided pin portions 30 are rounded.

Figure 22:
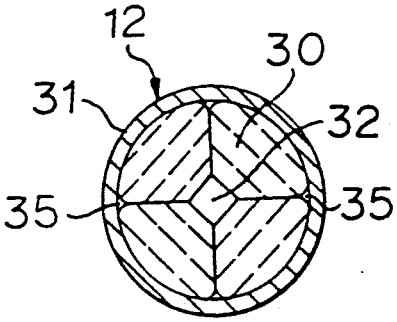

The contacting pin 12 as shown in FIG. 22 is the substantially same as that shown in FIG. 13 except that edges 35 of each of the longitudinally divided pin portions 30 are chamfered. Generally, a large thermal stress is apt to be produced at a corner or at an edge of ceramic products due to a temperature gradient at the time of heating or cooling. Accordingly, cracking or breaking is often caused at such a portion. Accordingly, by forming a rounded edge 34 or a chamfered edge 35 at the edges of each of the divided pin portions 30, generation of the thermal stress at the time of heating or cooling is minimized, and occurrence of cracking or breaking during handling can be prevented. Zirconium boride type monolithic refractory is filled in the through hole 32 formed at the axis and spaces formed between the rounded edges 34 and the chamfered edges 35 of each of the contacting pin 12, whereby invasion of molten steel can be avoided and the durability of each of the contacting pin 12 can be improved.

Although the assembled body comprising longitudinally divided pin portions 30 is bound by the metallic sleeve 31 in the above-mentioned embodiments, a metallic band may be used to bind the assembled body, instead of the sleeve 31. The sleeve 31 may be applied to a portion such as an upper portion, an intermediate portion or a lower portion of the contacting pin 12 without covering the entire outer circumference of it. In preferred embodiments of the bottom electrode for a direct current arc furnace of the present invention as described above, each of the contacting pins 12 is formed by assembling a plurality of pin portions 30 which are in a longitudinally divided form. Thereby, the cross-sectional area for current conduction of the contacting pin as an assembled body can be made large. Further, the contacting pin 12 is made large as a whole even though each of the longitudinally divided pin portions 30 are relatively thin. Accordingly, in the formation of longitudinally divided pin portions 30 by sintering zirconium boride type ceramics, sintered bodies having uniform, dense microstructure which are excellent in electric conductivity and mechanical strength can be obtained. Thus, the contacting pins 12 having excellent performance such as electric conductivity and durability can be obtained by assembling a plurality of the longitudinally divided pin portions 30 of sintered bodies.

An advantage of using large contacting pins is as follows. Since the number of the contacting pins used is not so much, it is easy to construct a bottom electrode, and the spaces between the adjacent contacting pins are broad, whereby bricks can be laid to fill the spaces between the adjacent contacting pins, instead of monolithic refractory, the bricks having more durability than the monolithic refractory.

FIG. 23 is a cross-sectional view showing a preferred embodiment of an important portion of the bottom electrode wherein a contacting pin 12 bound with a metallic cap 46 and a band 48 is connected to a power source by a connecting means.

In FIG. 23, the contacting pin 12 is arranged to penetrate a refractory material 18 and a base plate 13 in the same manner as shown in FIG. 1. Further, a lower portion of the contacting pin 12 is supported by the base plate 13 by means of a connecting means 41. The connecting means 41 comprises a cylindrical body 42 fixed to the base plate 13, a splitted ring 43 disposed in the cylindrical body 42, an intermediate ring 44 in contact with the splitted ring 43 in the cylindrical body 42 and a pushing screw 45 to force the splitted ring 43 against the contacting pin 12 through the intermediate ring 44. The contacting pin 12 extends in the vertical direction penetrating the above-mentioned members.

A tapered wall 42*a* which spreads downwardly is formed in the cylindrical body 42. The outer circumference of an upper portion of the splitted ring 43 is brought into contact with the tapered wall 42*a*. The splitted ring 43 is divided into three or four portions in its circumferential direction. The intermediate ring 44 is brought into contact with the outer circumference of a lower portion of the splitted ring 43. The pushing screw 45 is engaged with an opening formed at a lower portion of the cylindrical body 42 so that it pushes upwardly the splitted ring 43 through the intermediate ring 44, whereby the splitted ring 43 is urged inwardly along the tapered wall 42*a* to support the outer circumference of the contacting pin 12 and is electrically connected thereto.

The thermal expansion coefficient of the cylindrical body 42 is larger than (for instance, is about 2 times as large as) the thermal expansion coefficient of the contacting pin made of zirconium boride type sintered body. On the other hand, the splitted ring 43 is formed of a metal having greater thermal expansion coefficient than the cylindrical body 42. Accordingly, when an electric furnace with a bottom electrode wherein contacting pins 12 are fastened and connected to the bottom of the furnace, is operated at a high temperature, the connecting means 41 is also brought to an elevated temperature by heat transfer from the upper portion. In this case, since there is a difference in thermal expansion coefficient between the contacting pins 12 of zirconium boride type sintered body and the connecting means 41, there is a danger that a fastening force by the connecting means 41 becomes loose and electric connection is broken. However, in the specific embodiment of the present invention, since the splitted ring 43 is made of metal having a large thermal expansion coefficient, the splitted ring 43 expands in the cylindrical body 42 with increase of temperature, whereby there is no danger of loosening the holding force of the contacting pins 12 at an elevated temperature.

For the structure for connecting the contacting pins 12 as described above, another structure of connection may be used. For instance, the contacting pins are elastically fastened so as not to cause overheating of the elastic portion. Or, a thread is formed at the lower end of each of the contacting pins 12 formed of zirconium boride type sintered bodies; a metallic rod having a thread portion corresponding to that of the contacting pin 12, which has a thermal expansion coefficient close to that of zirconium boride, is connected to the thread portion of each of the contacting pins, and the metallic rod are fixed to the base plate 13.

In FIG. 23, a metallic cap 46 is attached to the upper end portion of the contacting pin 12 projecting from the upper surface of the monolithic refractory material 18, and a metallic band 48 is attached to an intermediate portion of the contacting pin 12. A zirconium oxide surface layer generates when the surface of the zirconium boride type sintered body is oxidized, whereby the electric conductivity of the surface layer is lost. At the time of starting operations after the replacement of the bottom electrode 11, the contacting pins 12 are heated under the condition that it is directly exposed to air. The metallic cap 46 covering the upper end portion of the contacting pins 12 prevents the surface of the contacting pin from oxidization by the contact of air at the starting of the operation. Further, in a case of putting scrap into the furnace, steel scrap attracted by a magnet is dropped near the bottom electrode. At this moment, a strong mechanical shock is applied to the bottom of furnace whereby the contacting pin 12 is sometimes damaged. The metallic cap 46 functions as a shock absorbing material to such mechanical shock and protects the contacting pins 12.

The contacting pins 12 as shown in FIGS. 8 through 22, the metallic sleeve 31 covers the outer circumference of each of the contacting pins. The metallic sleeve 31 covers the top surface of each of the contacting pins so as to function as the above-mentioned metallic cap 46.

TEST EXAMPLE

Tests were conducted by using an induction type electric heating furnace having an inner diameter of about 300 mm and a capacity of about 80 l as shown in FIG. 2, as a model of a bottom electrode of arc furnace for producing steel. A result will be explained hereinbelow. In FIG. 2, a reference numeral 1 designates an induction coil, a numeral 2 designates a metallic casing, a numeral 3 designates monolithic refractory, a numeral 4 designates a test contacting pin, a numeral 5 designates an upper electrode, numerals 6 designate copper terminals, a numeral 7 designates molten steel, numerals 8 designate cables, a numeral 9 designates an electric insulating material, and a numeral 10 designates a fitting metal piece.

Two kinds of contacting pins 4 having a size of 100 mm$\phi\times$400 mm were prepared for testing. One is of a zirconium boride type sintered body including 40 wt % of $ZrB_2$ coarse particles having a grain size of 28 mesh or larger (bulk density: 5.3 g/cm$^3$, bending strength: 510 kg/cm$^2$, specific resistivity: $2\times10^{-5}$ $\Omega$cm, thermal shock resistance: $\Delta T$; 1000° C.) and a zirconium boride type sintered body including 5 wt % of carbon and $ZrB_2$ coarse particles having a grain size of 28 mesh or larger (bulk density: 4.2 g/cm$^3$, bending strength: 450 kg/cm$^2$, specific resistivity: $2.4\times10^{-5}$ $\Omega$cm, thermal shock resistance: $\Delta T$; 1100° C.).

Two kinds of contacting pins having the same size were prepared for comparing. One is of extremely low carbon steel which has been conventionally used as contacting pin and the other is of a zirconium boride type sintered body including 10 wt % of $ZrB_2$ coarse particles having a grain size of 28 mesh o larger (bulk density: 4.5 g/cm$^3$, bending strength: 320 kg/cm$^2$, specific resistivity: $1.6\times10^{-5}$ Ωcm, thermal shock resistance: ΔT; 800° C.). As an upper electrode the same zirconium boride type sintered body as the contacting pin including carbon was used. The dimensions of the upper electrode was 100 mmϕ×500 mm.

The contacting pin 4 for testing is prepared as follows, for instance. $ZrB_2$ coarse particle of from 4 to 28 mesh, $ZrB_2$ particles of 28 mesh or lower, $ZrB_2$ powder of 150 mesh or lower and natural graphite powder are blended so that the content of $ZrB_2$ is 95% or higher, grog of 28 mesh or larger is 40% by weight and natural graphite is 5% by weight. Phenol resin (Resol type) is added to the blend followed by kneading to prepare pellets, the pellets are pressed by an isostatic press into a predetermined pillar shape. Then, the shape is sintered at a temperature higher than 2000° C. under the normal pressure in an environment of argon gas.

SS41 steel was previously cut in a size of about 20 mm. About 230 kg of cut pieces of SS41 steel was put in to the test furnace, and melted.

Magnesia type stamp material was mainly used for refractory lining. In some experiments, zirconium boride type castable was laid on the bottom of the test furnace for the purpose of testing.

The steel pieces were heated to be molten by increasing electric power by induction. In the furnace, a temperature of about 1600° C. was kept for about 1 hour. During heating, a fairly violent fluid state of molten steel was found. Power consumption during the holding time was about 90 KW.

During heating, air was forcibly supplied to cool the bottom of the electric furnace by an air blower. Soon after the electric induction power has been stopped, the electric resistance between the upper and lower electrodes was measured while the upper electrode was in contact with the molten steel. Then, the molten steel was entirely discharged by inclining the furnace, and after cooling the inside of the furnace was inspected. About 10 mm of corrosion was observed in the magnesia type stamp material which was in contact with the surface of the molten steel, in any tests. Results of the tests are shown in Table 4.

TABLE 4

| Structure of test furnace | Result |
|---|---|
| ① Bottom electrode; 5 wt % of carbon, 40 wt % of $ZrB_2$ coarse particles having a grain size of 28 mesh or larger. Monolithic refractory; magnesia type stamp material. | The resistance between electrodes was not more than 0.03 Ω and the consumption of the bottom electrode was small as incapable of detecting. The consumption of magnesia type stamp material at the bottom was about 5 mm. |
| ② Bottom electrode; 20 wt % of $ZrB_2$ coarse particles having a grain size of 28 mesh or larger. Monolithic refractory; magnesia type stamp material and zirconium boride type castable at the bottom. | The resistance between electrodes was not more than 0.03 Ω; the consumption of the bottom electrode was small as incapable of detecting, and the consumption of zirconium boride type castable at the bottom was little. |
| ③ Bottom electrode; 5 wt % of carbon, 40 wt % of $ZrB_2$ coarse particles having a grain size of 28 mesh or larger. Monolithic refractory; magnesia type stamp material and zirconium boride type castable at the bottom. | The resistance between electrodes was not more than 0.03 Ω; the consumption of the bottom electrode was small as negligible, and the consumption of zirconium boride type castable at the bottom was little. |
| ④ Bottom electrode; 10 wt % of $ZrB_2$ coarse particles having a grain size of 28 mesh or larger. Monolithic refractory; magnesia type stamp material | Cracking is produced in the transverse direction in the bottom electrode and the top portion is broken. Accordingly, normal measurement of the resistance between electrodes was impossible. |
| ⑤ Bottom electrode; extremely low carbon steel. Monolithic refractory; magnesia type stamp material | The consumption of the bottom electrode was about 25 mm. The consumption of magnesia type stamp material was about 15 mm. |

It was confirmed from the test that the contacting pins of zirconium boride type sintered bodies had no problem of electric conductivity in comparison with the conventionally used contacting pins of extremely low carbon steel; the zirconium boride type sintered body can be used as contacting pins for a bottom electrode for a direct current arc furnace, and they have excellent durability.

It was also confirmed that the thermal spolling resistance of the electrode could be effectively improved by using a zirconium boride type sintered body including not less than 15 wt % of $ZrB_2$ coarse particles having a grain size of 28 mesh or larger, in particular, in cooperation of not less than 3 wt % of carbon in the above zirconium boride type sintered body, and it was possible to operate a direct current arc furnace without breaking the contacting pins even when preliminarily heating (which requires especially careful handling) was omitted. Further, it was found that consumption of a furnace lining could be further reduced by using a zirconium boride type monolithic refractory for the bottom of the furnace.

A test furnace having an inner diameter of about 300 mm and a capacity of about 80 l as shown in FIG. 6 was used to examine the utility and the durability of the contacting pins. In FIG. 6, a numeral 41 designates a connecting means, a numeral 42 designates a cylindrical body, a numeral 43 designates a splitted ring, a numeral 44 designates an intermediate ring, a numeral 45 designates a pushing screw, a numeral 1 designates an induction coil, a numeral 2 designates a metallic casing, a numeral 3 designates monolithic refractory, a numeral 4 designates a test contacting pin, a numeral 5 designates an upper electrode having the same material as the test contacting pin containing therein carbon, numerals 6 designate copper terminals, a numeral 7 designates molten steel, numerals 8 designate cables, a numeral 9 designates an electric insulating material, and numeral 46 designates a metallic cap.

As the test contacting pin 4, a cylinder-shaped zirconium boride type sintered body having dimensions of 120 mmϕ×300 mm with a through hole at the axis whose diameter is 50 mmϕ, and which includes about 35 wt % of $ZrB_2$ coarse particles having a grain size of 28 mesh or larger and about 5 wt % of carbon (bulk density: 4.3 g/cm$^3$, bending strength: 460 kg/cm$^2$, specific resistivity: $2.2\times10^{-5}$ Ωcm, thermal shock resistance: ΔT; 1100° C.), was used.

The connecting means 41 which was the substantially same as that shown in FIG. 23 was attached to a lower end portion of the test contacting pin 4. The test contacting pin 4 was placed so as to penetrate the bottom portion of the cylindrical body 42, and the monolithic refractory 3 was laid inside the test furnace so as to fix the test contacting pin 4. Zirconium boride type monolithic refractory was charged in the axial hole of the test contacting pin 4.

A SS41 steel ingot was divided into pieces of about 10 mm and the pieces were put in the furnace. An electric current is fed to the induction coil 1 to melt the steel pieces by induction. When the steel was being molten at about 1600° C., the induction heating was stopped. Measurement of the electric resistance between the upper electrode and the test contacting pin under the condition that the upper electrode 5 was in contact with the molten steel revealed that the interelectrode resistance was 0.03 Ω or less.

The molten steel was heated again by induction for about 1.5 hours to keep the temperature of the molten steel at about 1600° C.. The induction heating was again stopped, and the electric resistance was measured in the same manner as described above. There was no substantial change in the interelectrode electric resistance.

The molten steel was discharged by inclining the furnace, and after cooling the inside of the furnace was examined if there was any change in the furnace. As a result, there was found no crack and little consumption of the zirconium boride type test contacting pin 4. There was found no looseness at the connecting means of the contacting pin except at the connecting portion to the upper electrode. The connecting portion was fastened before each measurement.

While the consumption of the magnesia type stamp material at the bottom of the furnace was about 12 mm, the consumption of the zirconium boride type stamp material which was filled in the hole formed in the electrode was small as 5 mm or less.

A test furnace having an inner diameter of about 300 mmϕ and a capacity of about 80 l (as shown in FIG. 24) which included a test contacting pin assembled with a plurality of longitudinally divided pin portions as a preferred embodiment of the present invention, was used. The utility and the durability of the bottom electrode using the test contacting pin was examined.

In FIG. 24, a reference numeral 1 designates an induction coil, a numeral 2 designates a metallic casing, a numeral 3 designates monolithic refractory, a numeral 4 designates a test contacting pin, a numeral 5 designates an upper electrode, numerals 6 designate copper terminals, a numeral 7 designates molten steel, numerals 8 designate cables, a numeral 9 designates an insulating material, a numeral 41 designates a connecting means, a numeral 42 designates a cylindrical body, a numeral 43 designates a splitted ring, a numeral 45 designates a pushing screw, a numeral 46 designates a cap of mild steel and a numeral 49 designates press-formed magnesia graphite type bricks.

The test contacting pin 4 was prepared as follows. Divided pin portions 30 which were formed by cutting a press-formed cylinder in the longitudinal direction in accordance with the specification described before. The divided pin portions 30 are sintered and the matching surfaces of the pin portions were ground. The four divided pin portions were bound to form a cylinder-shaped test contacting pin having dimensions of 150 mmϕ×400 mm in a through hole having an inner diameter of 50 mmϕ.

For a test contacting pin 4 and an upper electrode 5 of an one-piece product, a round rod having dimensions of 100 mmϕ×400 mm which was formed in one piece and sintered in accordance with the method described before, was used.

A cap 4 of mild steel having a thickness of 0.5 mm was put on the each end of the two kinds of the test contacting pin 4 and the upper electrode 5. A connecting means to a power source was formed in the same manner as that shown in FIG. 6.

The test contacting pin 4 was placed so as to penetrate the bottom of the casing 2 and so as to be embedded in the refractory 3. Zirconium boride type monolithic refractory was filled in the axial hole formed in the test contacting pin 4. Thus the test furnace was formed. Various tests were conducted for the test contacting pins 4.

An SS41 steel ingot was divided into pieces of about 10 mm and they were put in the furnace. An electric current was supplied to the induction coil 1 to melt the steel pieces by high frequency induction. Steel pieces were additionally put in the furnace while melting the steel pieces. During heating, the bottom of the furnace was forcibly cooled by an air blower. Soon after the induction heating was stopped, the interelectrode resistance was measured while the upper electrode 5 was in contact with the molten steel. It was found that the resistance was 0.03 Ω or less. Then, a power source was connected to the upper electrode 5 and the test contacting pin 4, and a current of 1500 A could be fed at a voltage of about 25 V. Thus, it was confirmed that stable current conduction is possible between the electrodes with every test contacting pin 4 was used.

The molten steel was discharged through an outlet formed at a lower portion of the side surface of the furnace (not shown). The outlet was then closed and steel ingot pieces were put in the furnace while the steel was molten by induction. The interelectrode resistance between the upper electrode 5 and the test contacting pin 4 was again measured. For the each of test contacting pins, the resistance was 0.03 Ω or less. In melting steel again, looseness at the connecting means or increase in the interelectrode resistance due to oxidization of the surface of the test contacting pins were not observed. However, contact failure was sometimes observed at the connecting portion of the upper electrode and the cable. Accordingly, the measurement of the interelectrode resistance and electric conduction test were carried out after the connecting terminal was fastened and good contacting state was confirmed.

Then, the upper electrode was removed and the molten steel was kept at about 1600° C. for 2 hours by induction heating. Then, the furnace was inclined to discharge all of the molten steel. After the furnace was cooled, the state of change of the test contacting pin 4 and the refractory was examined. As a result of examination, no crack was found in either zirconium boride type test contacting pin 4 of an one-piece product or that formed by assembling a plurality of pin portions. Further, little consumption and oxidization was observed in working surface of the contacting pins. There was no looseness at the connecting means between the test contacting pin and the power source, and good electric contact was maintained. With respect to the refractory, although some progress of corrosion was observed at the part of the monolithic refractory, there was a slight corrosion at a part of the magnesia graphite type brick 49 which was press-formed and embedded in the monolithic refractory. From the result of the tests, it was confirmed that the zirconium boride type contacting pin formed by assembling the pin portions could be used without problem in the same manner as the contacting pin of an one-piece product. Further, it was also confirmed that the bricks are more durable than the monolithic refractory.

As described above, in accordance with the bottom electrode of the present invention, it was confirmed that the service life of the contacting pins could be prolonged more than 10 times as long as the conventional contacting pins by using zirconium boride type ceramics as the contacting pins for the bottom electrode.

In the present invention, since each of the preferred contacting pins is formed by assembling a plurality of longitudinally divided pin portions, each of the divided pin potions is relatively thin even though an assembled contacting pin is large, and it is possible to obtain the contacting pins having uniform, dense microstructure by pressurless sintering. Further, contacting pins having good electric conductivity, mechanical strength and thermal shock resistance can be obtained. Thus, the diameter of a contacting pin can be large without impairing the characteristics of the contacting pin, whereby a current load for a single contacting pin can be increased. Accordingly, a large current can be charged even when the number of the contacting pins is relatively small. Further, because the space between the contacting pins can be broad bricks having good durability can be laid around the contacting pins.

It is possible to prolong the service life of the entire bottom electrode by using press-formed bricks as refractory around the contacting pins. As a result, the service life of the bottom electrode can be prolonged nearly to the service life of the refractory lining in the direct current arc furnace, and the frequency of repairing the furnace can be remarkably reduced.

What is claimed is:

1. A bottom electrode for a direct current arc furnace which comprises:

a plurality of vertically elongated contacting pins, each having an exposed upper portion which is brought into contact with a batch to be molten to heat the batch through a discharge of an electric arc, refractory filled to surround a lower portion of the contacting pins extending from the exposed upper portion, a connecting means to be connected to a power source, which is provided at a lower end of the contacting pins, and a cooling means to cool the connecting means, and each of the contacting pins formed of a zirconium boride type sintered body containing from 15 weight percent to 50 weight percent of grog having a grain size larger than 28 meshes.

2. The bottom electrode for a direct current arc furnace according to claim 1, wherein at least upper portion of the refractory filled to surround the lower portion of the contacting pins extending from the exposed upper portion is a zirconium boride type monolithic refractory.

3. The bottom electrode for a direct current arc furnace according to claim 1, wherein the zirconium boride type sintered body further includes from 3 weight percent to 40 weight percent of carbon.

4. The bottom electrode for a direct current arc furnace according to claim 1, wherein each of the contacting pins has a pillar-shaped body having a through hole formed at a vertical axis, and a refractory is filled in the through hole.

5. The bottom electrode for a direct current arc furnace according to claim 1, wherein lower portions of the contacting pins are held by a connecting means comprising a metallic member having a large thermal expansion coefficient and a metallic member having a small thermal expansion coefficient so as to eliminate looseness due to temperature rise, and are electrically connected to the power source.

6. The bottom electrode for a direct current arc furnace according to claim 4, wherein the refractory filled in the through hole is a zirconium boride type monolithic refractory.

7. The bottom electrode for a direct current arc furnace according to claim 1, wherein each of the contacting pins is an assembled body of a plurality of longitudinally divided pin portions.

8. The bottom electrode for a direct current arc furnace according to claim 7, having 3 to 7 longitudinally divided pin portions.

9. The bottom electrode for a direct current arc furnace according to claim 7, wherein the assembled body of the longitudinally divided pin portions is bound with a metallic band or sleeve to surround a circumferential area of the assembled body.

10. The bottom electrode for a direct current arc furnace according to claim 7, wherein metallic plates are interposed between mating surfaces of the longitudinally divided pin portions.

11. The bottom electrode for a direct current arc furnace according to claim 7, wherein edges formed in the longitudinally divided pin portions are chamfered.

12. The bottom electrode for a direct current arc furnace according to claim 1, wherein a metallic cap is put on each of the contacting pins to cover at least its upper portion.

13. The bottom electrode for a direct current arc furnace according to claim 4, wherein a metallic cap is put on each of the contacting pins to cover at least its upper portion.

14. The bottom electrode for a direct current arc furnace according to claim 7, wherein a metallic cap is put on each of the contacting pins to cover at least its upper portion.

15. The bottom electrode for a direct current arc furnace according to claim 4, wherein at least upper portion of the refractory filled to surround the lower portion of the contacting pins extending from the exposed upper portion are bricks.

16. The bottom electrode for a direct current arc furnace according to claim 7, wherein at least upper portion of the refractory filled to surround the lower portion of the contacting pins extending from the exposed upper portion are bricks.

17. The bottom electrode for a direct current arc furnace according to claim 15, wherein the bricks are magnesia graphite type bricks.

18. The bottom electrode for a direct current arc furnace according to claim 4, wherein lower portions of the contacting pins are held by a connecting means comprising a metallic member having a large thermal expansion coefficient and a metallic member having a small thermal expansion coefficient so as to eliminate looseness due to temperature rise, and are electrically connected to the power source.

19. The bottom electrode for a direct current arc furnace according to claim 7, wherein edges formed in the longitudinally divided pin portions are rounded.

20. The bottom electrode for a direct current arc furnace according to claim 15, wherein the bricks are zirconium boride type bricks.

* * * * *